US007367296B2

(12) United States Patent
Degner et al.

(10) Patent No.: US 7,367,296 B2
(45) Date of Patent: May 6, 2008

(54) BI-DIRECTIONAL POWER ELECTRONICS CIRCUIT FOR ELECTROMECHANICAL VALVE ACTUATOR OF AN INTERNAL COMBUSTION ENGINE

(75) Inventors: Michael Degner, Novi, MI (US); John Grabowski, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/390,887

(22) Filed: Mar. 27, 2006

(65) Prior Publication Data

US 2006/0162680 A1 Jul. 27, 2006

Related U.S. Application Data

(62) Division of application No. 10/873,712, filed on Jun. 21, 2004, now Pat. No. 7,036,469.

(51) Int. Cl.
*F01L 9/04* (2006.01)

(52) U.S. Cl. ..... 123/90.11; 251/129.01; 361/160

(58) Field of Classification Search ..... 123/90.11; 251/129.01, 129.15, 129.16; 361/154, 160, 361/190

See application file for complete search history.

(56) References Cited

U.S. PATENT DOCUMENTS 3,884,207 A 5/1975 Kuehn, III
4,794,890 A 1/1989 Richeson, Jr.
5,124,598 A 6/1992 Kawamura
5,596,956 A 1/1997 Ogawa et al.
5,669,341 A 9/1997 Ushirono et al.
5,775,276 A 7/1998 Yanai et al.
5,804,962 A 9/1998 Kather et al.
5,940,262 A 8/1999 Archer
6,186,100 B1 2/2001 Sawada
6,201,681 B1 3/2001 Torii et al.
6,202,608 B1 3/2001 Yamaki et al.
6,363,895 B1 4/2002 Butzman et al.
6,374,783 B1 4/2002 Toriumi
6,626,146 B1 9/2003 Yanai et al.
6,631,067 B2 10/2003 Newton et al.
7,021,255 B2 4/2006 Degner et al.
7,036,469 B2 5/2006 Degner et al.
7,051,687 B2 5/2006 Shimizu et al.
7,054,737 B2 5/2006 Degner et al.
2002/0104494 A1 8/2002 Ozawa et al.
2005/0207086 A1 9/2005 Degner et al.

FOREIGN PATENT DOCUMENTS

DE 19701471 7/1998
EP 1010867 7/2004

*Primary Examiner*—Ching Chang
(74) *Attorney, Agent, or Firm*—Donald Lewis; Alleman Hall McCoy Russell & Tuttle LLP

(57) ABSTRACT

A bi-directional dual coil half bridge converter adapted to be coupled to a dual coil actuator of a cylinder valve in an internal combustion engine is described. In one example, the converter has a first and second capacitor and a voltage source, where the converter is actuated via switches to individually energizing coils in said dual coil actuator. A voltage regulator is also shown for maintaining midpoint voltage during unequal loading of different actuator coils in the converter.

7 Claims, 8 Drawing Sheets

BI-DIRECTIONAL POWER ELECTRONICS CIRCUIT FOR ELECTROMECHANICAL VALVE ACTUATOR OF AN INTERNAL COMBUSTION ENGINE

CROSS-REFERENCE TO RELATED APPLICATIONS

The present application is a divisional of U.S. patent application No. 10/873,712, filed Jun. 21, 2004 now U.S. Pat. No. 7,036,469, and titled "Bi-Directional Power Electronics Circuit for Electromechanical Valve Actuator of an Internal Combustion Engine," the entire contents of which are incorporated herein by reference.

FIELD

The field of the disclosure relates to power electronics for electromechanical actuators coupled to cylinder valves of an internal combustion engine, and more particularly for a dual coil valve actuator.

BACKGROUND AND SUMMARY

In multi-phase electronic converter applications, a number of bridge driver circuits (full or half) can be cascaded together while sharing a common power supply 110. A full bridge converter 100 is shown in FIG. 1 with four actuators (120) cascaded together. In this design, each load element 120 (actuator) is independently controlled by modulating the conduction of the appropriate power devices, in one of the three voltage operating modes (positive voltage, negative voltage, free-wheeling mode) by actuating switches 112 and 118, 114 and 116, 112 and 116 or 114 and 118, respectively. Note also that a half-bridge configuration can also be used for applications that do not require bi-directional current flow (where the power switches (114 and 116) are replaced with power diodes).

However, the inventors herein have recognized a disadvantage when trying to use such converter designs to control electromechanically actuated valves of a cylinder in an internal combustion engine. For example, a full bridge converter can require four power devices (4 switches) for each electromagnet. And, since electrically actuated valves of an engine typically use two actuator coils per cylinder, a typical 32 valve V-8 engine would require 256 devices. This creates a significant added cost for an engine with electromechanically actuated valves, even if not all valves are electrically powered. Further, not only would the above converter approaches require significant numbers of devices, but would also increase wiring and harness costs, since two wires are required per actuator coil.

As another example, in the case of a half bridge converter, when used with actuators having embedded permanent magnets, improved operation may be obtained using bi-directional current. However, such a converter may not provide such operation, and therefore may lose the advantage of having permanent magnet enhancements. Further, such a converter may still require 4 power devices (2 switches and 2 diodes) per electromagnet.

The above disadvantages can be overcome by an electronic circuit, comprising:

a first electromechanical actuator coil coupled to one of a plurality of cylinder valves of an internal combustion engine, where a first end of said first electromechanical actuator coil is coupled to a reference;

a second electromechanical actuator coil, where a first end of said first electromechanical actuator coil is coupled to said reference;

a first energy storage device, where a first end of said first energy storage device is coupled to said reference;

a second energy storage device, where a first end of said second energy storage device is coupled to said reference;

a first switch, where a first end of said first switch is coupled to a second end of said first electromechanical actuator coil; and a second switch, where a first end of said second switch is coupled to said second end of said second electromechanical actuator coil.

In this way, it is possible to obtain bi-directional current control while still offering a reduction in device count and wire count. Thus, it may be possible to provide improved cost, reduced complexity, and reduced packaging space.

DESCRIPTION OF EXAMPLE EMBODIMENTS

Figure 2:
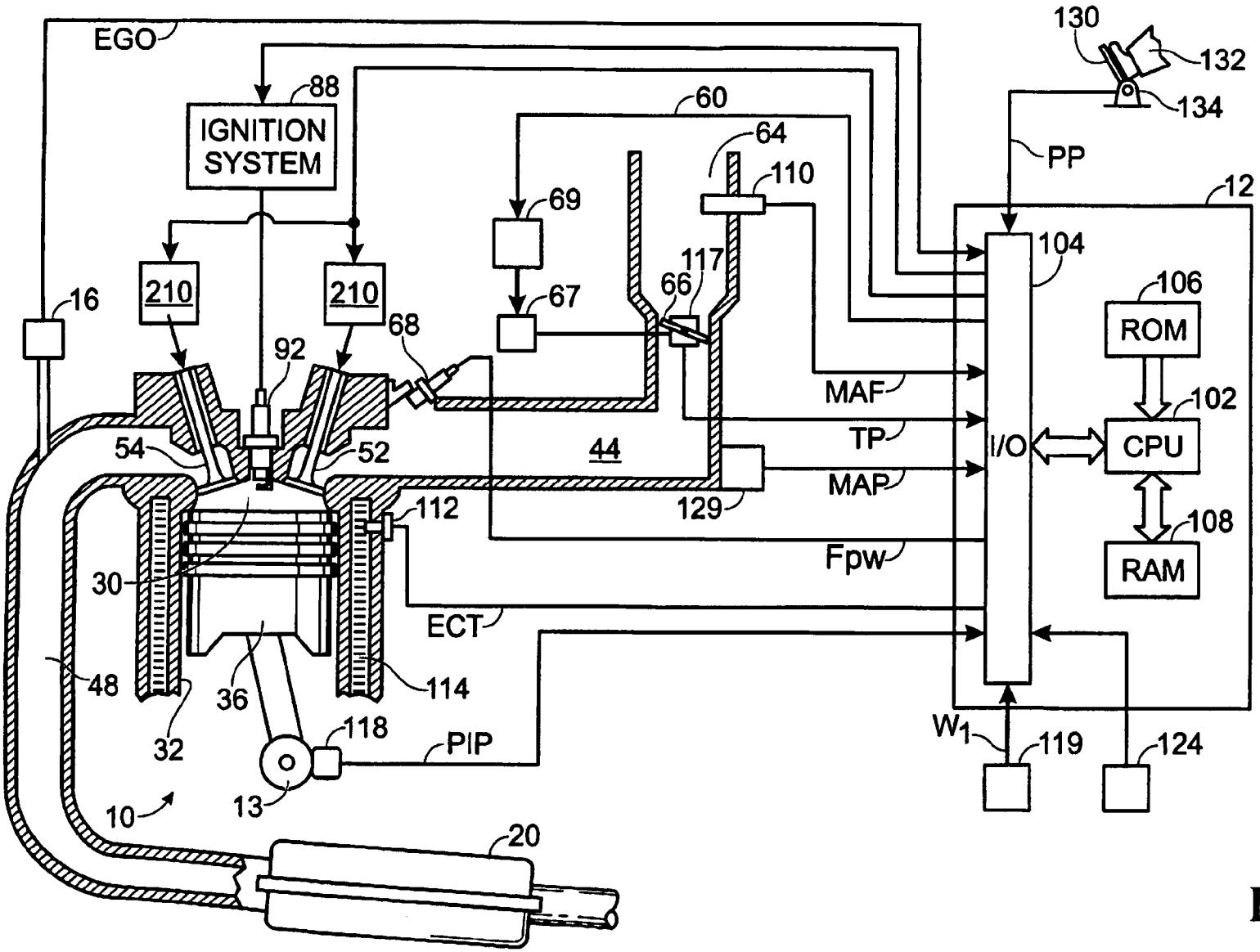
FIG. 2 is a block diagram of a engine illustrating various components.
Figure 3B:
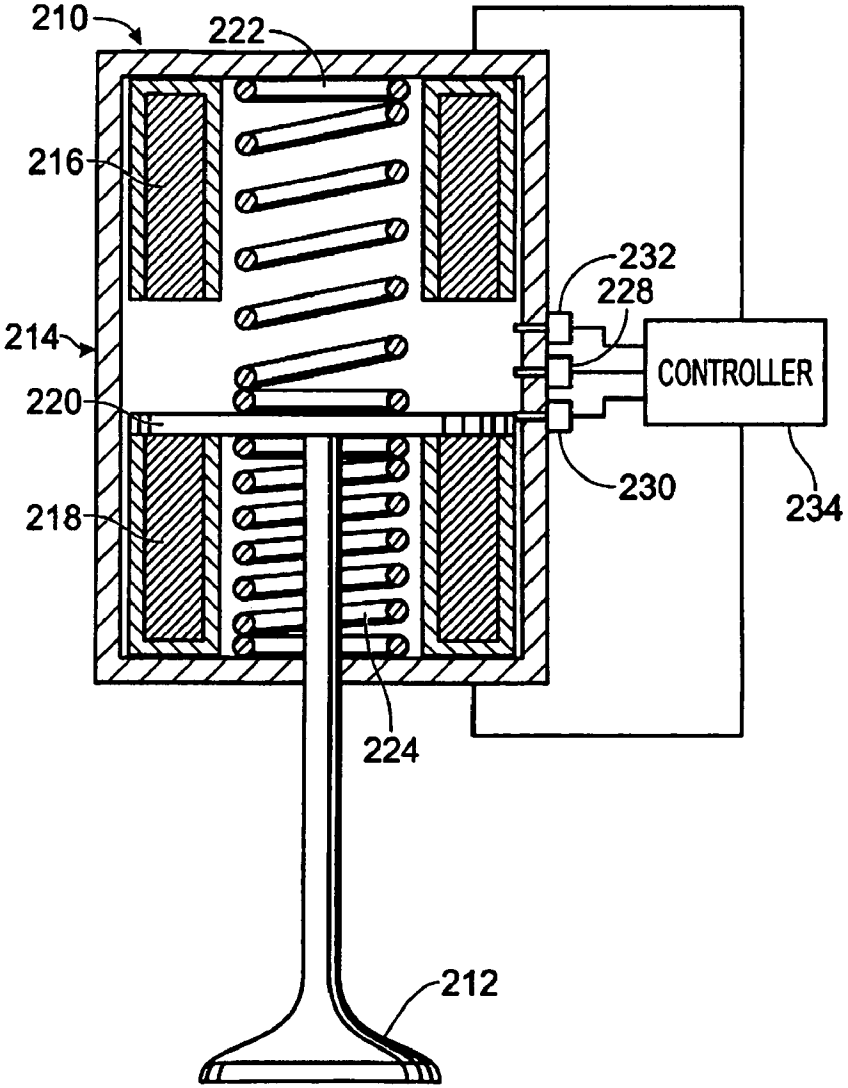
FIG. 3B shows a schematic vertical cross-sectional view of an apparatus for controlling valve actuation as shown in FIG. 2, with the valve in the fully open position.
Figure 3A:
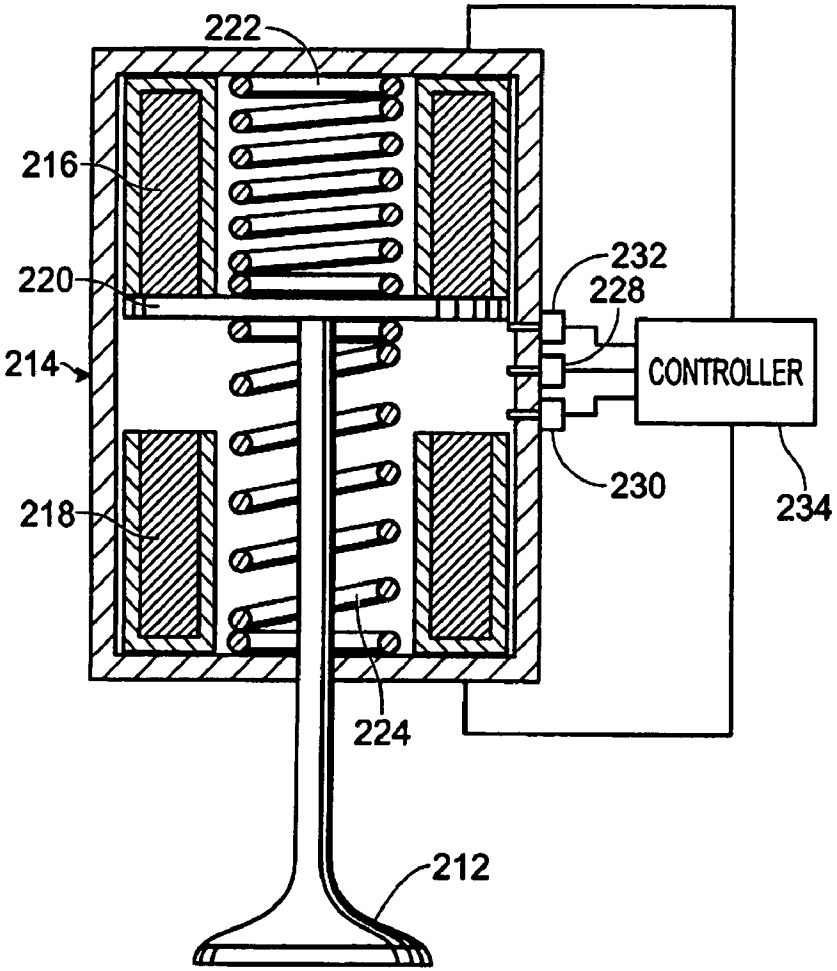
FIG. 3A show a schematic vertical cross-sectional view of an apparatus for controlling valve actuation, with the valve in the fully closed position.
Figure 4:
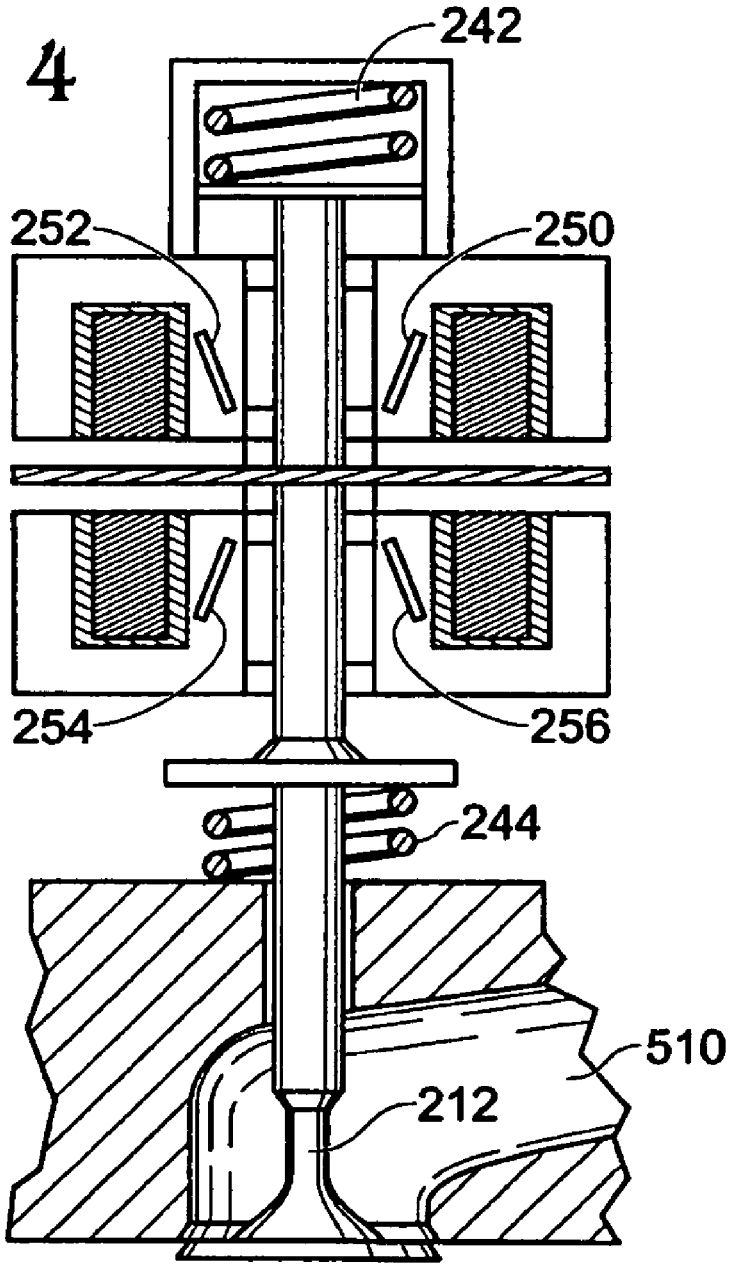
FIG. 4 shows an alternative electronic valve actuator configuration.

This disclosure outlines a converter topology form that can provide advantageous operation, especially when used with permanent magnet enhanced Electro-magnetic Valve Actuation (EVA) solenoid drivers of an internal combustion engine, as shown by FIGS. 2-4. This improved topology may result in a lower cost and lower component requirements, while maintaining desired functionality.

Referring to FIG. 2, internal combustion engine 10 is shown. Engine 10 is an engine of a passenger vehicle or truck driven on roads by drivers. Engine 10 can be coupled to a torque converter via crankshaft 13. The torque converter can also be coupled to transmission via a turbine shaft. The torque converter has a bypass clutch which can be engaged, disengaged, or partially engaged. When the clutch is either disengaged or partially engaged, the torque converter is said to be in an unlocked state. The turbine shaft is also known as transmission input shaft. The transmission comprises an electronically controlled transmission with a plurality of selectable discrete gear ratios. The transmission also comprises various other gears such as, for example, a final drive ratio. The transmission can also be coupled to tires via an axle. The tires interface the vehicle to the road.

Internal combustion engine 10 comprising a plurality of cylinders, one cylinder of which, shown in FIG. 2, is controlled by electronic engine controller 12. Engine 10 includes combustion chamber 30 and cylinder walls 32 with piston 36 positioned therein and connected to crankshaft 13. Combustion chamber 30 communicates with intake manifold 44 and exhaust manifold 48 via respective intake valve 52 and exhaust valve 54. Exhaust gas oxygen sensor 16 is coupled to exhaust manifold 48 of engine 10 upstream of catalytic converter 20. In one example, converter 20 is a three-way catalyst for converting emissions during operation about stoichiometry.

As described more fully below with regard to FIGS. 3A and 3B, at least one of, and potentially both, of valves 52 and 54 are controlled electronically via apparatus 210.

Intake manifold 44 communicates with throttle body 64 via throttle plate 66. Throttle plate 66 is controlled by electric motor 67, which receives a signal from ETC driver 69. ETC driver 69 receives control signal from controller 12. In an alternative embodiment, no throttle is utilized and airflow is controlled solely using valves 52 and 54. Further, when throttle 66 is included, it can be used to reduce airflow if valves 52 or 54 become degraded, or to create vacuum to draw in recycled exhaust gas (EGR), or fuel vapors from a fuel vapor storage system having a valve controlling the amount of fuel vapors.

Intake manifold 44 is also shown having fuel injector 68 coupled thereto for delivering fuel in proportion to the pulse width of signal (fpw) from controller 12. Fuel is delivered to fuel injector 68 by a conventional fuel system (not shown) including a fuel tank, fuel pump, and fuel rail (not shown).

Engine 10 further includes conventional distributorless ignition system 88 to provide ignition spark to combustion chamber 30 via spark plug 92 in response to controller 12. In the embodiment described herein, controller 12 is a conventional microcomputer including: microprocessor unit 102, input/output ports 104, electronic memory chip 106, which is an electronically programmable memory in this particular example, random access memory 108, and a conventional data bus.

Controller 12 receives various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling jacket 114; a measurement of manifold pressure from MAP sensor 129, a measurement of throttle position (TP) from throttle position sensor 117 coupled to throttle plate 66; a measurement of turbine speed (Wt) from turbine speed sensor 119, and a profile ignition pickup signal (PIP) from Hall effect sensor 118 coupled to crankshaft 13 indicating an engine speed (N). Alternatively, turbine speed may be determined from vehicle speed and gear ratio.

Continuing with FIG. 2, accelerator pedal 130 is shown communicating with the driver's foot 132. Accelerator pedal position (PP) is measured by pedal position sensor 134 and sent to controller 12.

In an alternative embodiment, where an electronically controlled throttle is not used, an air bypass valve (not shown) can be installed to allow a controlled amount of air to bypass throttle plate 66. In this alternative embodiment, the air bypass valve (not shown) receives a control signal (not shown) from controller 12.

Also, in yet another alternative embodiment, intake valve 52 can be controlled via actuator 210, and exhaust valve 54 actuated by an overhead cam, or a pushrod activated cam. Further, the exhaust cam can have a hydraulic actuator to vary cam timing, known as variable cam timing.

In still another alternative embodiment, only some of the intake valves are electrically actuated, and other intake valves (and exhaust valves) are cam actuated.

Note that the above approach is not limited to a dual coil actuator, but rather it can be used with other types of actuators. For example, the actuators of FIG. 3 or 4 can be single coil actuators. In any case, the approach synergistically utilizes the high number of actuators (engine valves, in this example) to aid in reducing the number of power devices and the size of the wiring harness. Thus, the dual coil actuator increases this synergy, but a single coil actuator would have similar potential.

Referring to FIGS. 3A and 3B, an apparatus 210 is shown for controlling movement of a valve 212 in camless engine 10 between a fully closed position (shown in FIG. 3A), and a fully open position (shown in FIG. 3B). The apparatus 210 includes an electromagnetic valve actuator (EVA) 214 with upper and lower coils 216, 218 which electromagnetically drive an armature 220 against the force of upper and lower springs 222, 224 for controlling movement of the valve 212.

Switch-type position sensors 228, 230, and 232 are provided and installed so that they switch when the armature 220 crosses the sensor location. It is anticipated that switch-type position sensors can be easily manufactured and when combined with appropriate asynchronous circuitry they would yield a signal with the rising edge when the armature crosses the sensor location. It is furthermore anticipated that these sensors would result in cost reduction as compared to continuous position sensors, and would be reliable.

Controller 234 (which can be combined into controller 12, or act as a separate controller) is operatively connected to the position sensors 228, 230, and 232, and to the upper and lower coils 216, 218 in order to control actuation and landing of the valve 212.

The first position sensor 228 is located around the middle position between the coils 216, 218, the second sensor 230 is located close to the lower coil 218, and the third sensor 232 is located close to the upper coil 216.

As described above, engine 10, in one example, has an electromechanical valve actuation (EVA) with the potential to maximize torque over a broad range of engine speeds and substantially improve fuel efficiency. The increased fuel efficiency benefits are achieved by eliminating the throttle, and its associated pumping losses, (or operating with the throttle substantially open) and by controlling the engine operating mode and/or displacement, through the direct control of the valve timing, duration, and or lift, on an event-by-event basis.

In one example, controller 234 includes any of the example power converters described below.

While the above method can be used to control valve position, an alternative approach can be used that includes continuous position sensor feedback for potentially more accurate control of valve position. This can be use to improve overall position control, as well as valve landing, to possibly reduce noise and vibration.

FIG. 4 shows an alternative embodiment dual coil oscillating mass actuator with an engine valve actuated by a pair of opposing electromagnets (solenoids), which are designed to overcome the force of a pair of opposing valve springs 242 and 244 located differently than the actuator of FIGS. 3A and 3B (other components are similar to those in FIGS. 3A and 3B, except that FIG. 4 shows port 510, which can be an intake or exhaust port). Applying a variable voltage to the electromagnet's coil induces current to flow, which controls the force produced by each electromagnet. Due to the design illustrated, each electromagnet that makes up an actuator can only produce force in one direction, independent of the polarity of the current in its coil. High performance control and efficient generation of the required variable voltage can therefore be achieved by using a switch-mode power electronic converter.

As illustrated above, the electromechanically actuated valves in the engine remain in the half open position when the actuators are de-energized. Therefore, prior to engine combustion operation, each valve goes through an initialization cycle. During the initialization period, the actuators are pulsed with current, in a prescribed manner, in order to establish the valves in the fully closed or fully open position. Following this initialization, the valves are sequentially actuated according to the desired valve timing (and firing order) by the pair of electromagnets, one for pulling the valve open (lower) and the other for pulling the valve closed (upper).

The magnetic properties of each electromagnet are such that only a single electromagnet (upper or lower) need be energized at any time. Since the upper electromagnets hold the valves closed for the majority of each engine cycle, they are operated for a much higher percentage of time than that of the lower electromagnets.

Further, in one example, one or more of the actuator cores may include a permanent magnet, such as magnets 250, 252, 254, and/or 256. Thus, in one example, a valve actuator for an internal combustion engine may include at least one electromagnet having a coil wound about a core, an armature fixed to an armature shaft extending axially through the core, and axially movable relative thereto, and at least one permanent magnet extending at least partially into an interior portion of the coil.

In one specific example, such an approach can be used so that the area of the permanent magnet surface contacting the core is larger than the center pole area facing the armature. As a result, the flux density in the center pole surface may be significantly higher than the flux density in the permanent magnet material's surface, which is limited by the permanent magnet material property. Further, since the magnetic force may be proportional to the square of the flux density, this embodiment can increase (significantly in some examples) the force, without necessarily increasing the size of the actuator. And since the permanent magnet is in the path of the flux produced by the current, in one example, the actuator can have a low dF/dx (rate of change of force with respect to changes in position) and dF/di (rate of change of force with respect to changes in current), which can be beneficial for landing speed control.

As such, various advantages can be achieved in some cases, such as decreased resistance, decreased height requirements, and increased force output, while maintaining reduced dF/dx and dF/di (which can help valve landing control).

In another example embodiment, the valve actuator can comprise a core having a wound coil located therein, where the core has at least one permanent magnet located at least partially below the coil and positioned at an angle relative to a direction of movement of an armature. The inner part of said permanent magnet may be located closer to the coil than an outer part of said permanent magnet, where the inner part of the permanent magnet is located closer to a center of the core than the outer part of said permanent magnet. Further, the valve actuator can further comprise a first gap (not shown) at the inner part of the permanent magnet and a second gap at the outer part of the permanent magnet.

By having such a configuration, it may also possible to obtain improved actuator force performance, while reducing coil resistance and improving valve manufacturability. Further, in some examples using gaps near selected areas of the permanent magnet, flux leakage may be reduced.

While FIG. 4 shows one example permanent magnet configuration, various others can be used. For example, various angles can be used, and the angle illustrated can be rotated by 180 degrees about the center, if desired. Also, while FIGS. 3A, 3B, and 4 appear to show the valves to be permanently attached to the actuators, in practice there can be a gap to accommodate lash and valve thermal expansion.

Figure 5:
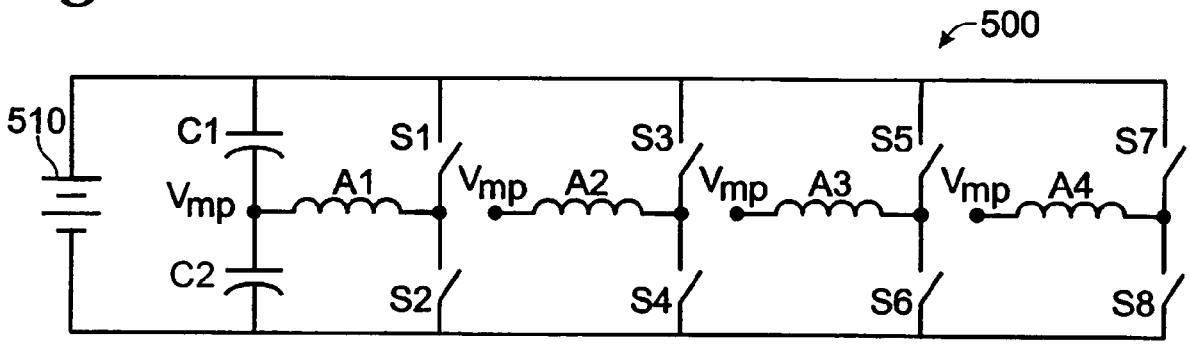
FIG. 5 shows a bi-directional dual coil converter (split supply version)

Referring now to FIG. 5, a diagram shows one embodiment of a bi-directional dual coil half-bridge converter design, which requires a reduced number of power devices and/or gate drive circuits when compared with prior art half-bridge converters, while providing the ability for accurate valve control and bi-directional current control. This configuration may therefore result in a significant cost savings for the valve control unit (VCU) of the EVA system. In addition, this example converter may also cut the number of power wires between the VCU and the actuators, which can significantly reduce the wire harness/connectors cost and weight.

Note that while the examples herein use a dual coil actuator, the converter topology is not limited to dual coil actuators. Rather, it can be used with any system that utilizes multiple actuator coils. Thus, it should be noted that adjacent pairs of converter switches are not necessarily confined to be paired with a single actuators' coils (i.e. each coil of a given actuator may be driven by switches from different legs of the converter), although they may be.

In the above example, a split-power supply, which provides a return path for the actuator coil currents, is used. In one example, the split supply could be realized using a pair of batteries. However, this may unnecessarily add cost and weight to the vehicle. Therefore, in another example, a split capacitor bank can be used to transform a single battery into a dual voltage source, as shown in FIG. 5.

Note that a capacitor is an example of an energy storage device, and various types of devices can be used to act as a capacitor or energy storage device.

In the example bi-directional dual coil half-bridge design, each actuator coil may be connected to the split voltage supply through what can be thought of as a DC/DC converter. Operation using a high-side switch forms a buck DC/DC converter from the supply voltage to the split voltage (mid-point voltage), and operation using a low-side switch forms a boost DC/DC converter from the split voltage to the supply voltage.

The coils are actuated and/or deactivated via coordination of their respective switch pair, and the capacitors alternately charge and discharge during the operation of the coils.

Referring now specifically to FIG. 5, an example converter circuit 500 is shown, with power supply (such as, for example, the vehicle battery) 510 and four actuator coils (A1, A2, A3, and A4). However, any type of power source could be used. Also, in an alternative embodiment, the single voltage source could be replaced with a dual voltage source (i.e. two voltage sources, each placed in parallel across each of the two split capacitors).

In one embodiment, actuators A1 and A2 represent the two coils of an intake valve in a cylinder of the engine, and actuators A3 and A4 represent an exhaust valve of the same cylinder of the engine. In another embodiment, actuators A1 and A2 represent the two coils of an intake valve in a cylinder of the engine, and actuators A3 and A4 represent an intake valve in another (different) cylinder, or the same cylinder, of the engine. Further, in another embodiment, actuators A1 and A2 represent the two coils of an exhaust valve in a cylinder of the engine, and actuators A3 and A4 represent an exhaust valve in another (different) cylinder, or the same cylinder, of the engine. As indicated and discussed below, certain configuration can provide a synergistic result in terms of maintaining a balance of charge in the capacitors.

Continuing with FIG. 5, eight switches are shown (S1, S2, S3, S4, S5, S6, S7, and S8), with two switches providing current to/from an actuator (e.g., S1 and S2 energizes/de-energizes A1, etc.). Selective actuation of the switches may provide for flyback current (or freewheel current) when deactivating a valve due to the high inductance of the actuator coils. Two capacitors are shown (C1 and C2 are shown). In one example, capacitors C1 and C2 have substantially equal capacitance, however different capacitances can also be used, if desired. This is an example of a split capacitor voltage source (SCVS), where the midpoint voltage can be indicated as Vmp.

One arrangement would have the four actuator coils be the upper and lower coils for two intake or two exhaust actuators on the same cylinder. In this case, coils A1 and A2 would be the two upper coils of the two actuators and A3 and A4 would be the two lower coils (or vice versa).

Figure 6:
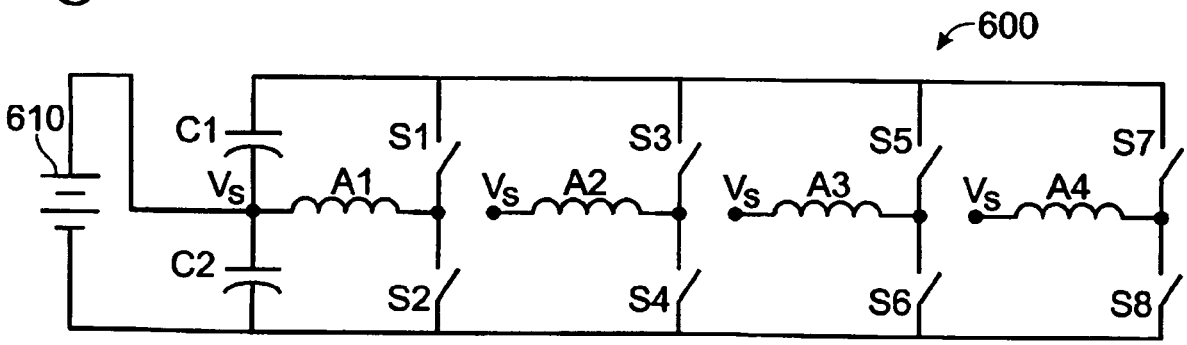
FIG. 6 shows a bi-directional dual coil converter (boosted supply version)

An alternative embodiment can be accomplished by changing the wiring connections between the battery and the capacitors, as shown in FIG. 6. This alternate circuit configuration may have substantially the same circuit function as the circuit in FIG. 5. However, one difference in the boosted circuit design of FIG. 6 is the battery is now connected across only one half of the split voltage supply. In one embodiment, the configuration of the coils to aid in maintaining a charge balance using this configuration of the converter may follow the same procedure as described below for the design shown in FIG. 5. Again, each configuration for the dual coil half-bridge converter may provide substantially similar function, however, the voltage and current rating of the converter components may be different due to the difference in currents and voltages.

Referring now specifically to FIG. 6, converter 600 is shown with four coils A1-A4. Further, the Figure identifies 4 nodes tied to the output of power supply 610 as Vs (indicating source voltage). One end of each actuator is coupled to a Vs node. Further, each coil has two corresponding switches (S1-S8), with switches S1 and S2 energizing/de-energizing coil A1, etc. In addition, capacitors C1 and C2 are coupled in the converter, with capacitor C2 coupled in parallel with power supply 610.

Note that while only four actuator coils are shown in FIGS. 5 and 6, additional stages can be created and cascaded so that all of the valve actuators are included, each with a pair of actuating switches.

Figure 1:
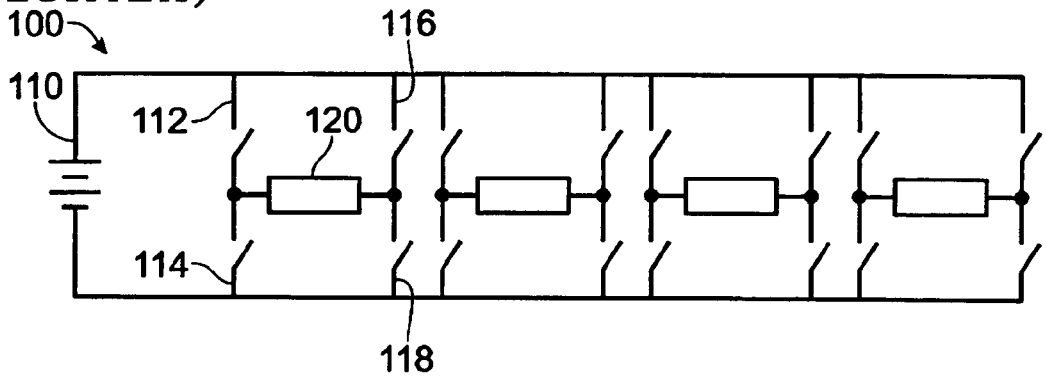
Fig. 1 (PRIOR ART)
FIG. 1 shows a full-bridge electronic converter.
Figure 7:
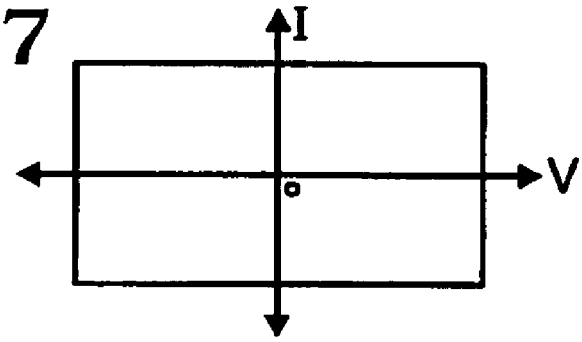
FIG. 7 shows the operating range of the converters of FIGS. 5-6.

Thus, FIGS. 5 and 6 show two versions of bi-directional dual coil converters. These circuits may be derived from the dual coil half bridge converter by replacing the diodes in that converter with active switches and allow bi-directional current control with four quadrant operation. Thus, the example converters of FIGS. 5 and 6 can provide a current versus voltage operating range as shown in FIG. 7, thus allowing substantially the same functionality as a full bridge converter (e.g., as in FIG. 1), while reducing cost and complexity.

Regardless of the power supply configuration, in a full bridge converter, the power devices may be arranged in such a manner to permit controlled actuator current in both directions. To more fully explain the circuit operation, additional description of an example power device characteristic, as well as typical current command waveforms, is provided.

Figure 8:
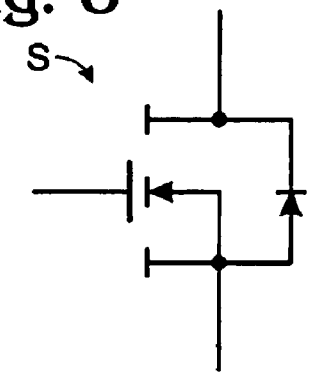
FIG. 8 shows a power MOSFET equivalent circuit detail.

For automotive voltage levels, the power device may be the power MOSFET, in one example, although others may be used such as IGBTs. Included in the basic structure of the MOSFET is a power switching device and an anti-parallel diode, as shown in FIG. 8. This diode may be part of the MOSFET semiconductor structure and may be designed to withstand similar voltage and current levels. The diode may also provide functions in the operation of a power electronic converter, such as in a bi-directional Dual Coil Converter.

During example operation of the circuit in FIG. 5, for example, a controller calculates a current trajectory and issues a command to the converter input. The power converter may then produce the proper switching sequences which cause the actuator currents to track the commanded input. To do this, the converter operates in at least four modes; positive current and negative current, with either positive or negative voltage. In each mode, a power switch may be turned on to increase the actuator current level, and when the desired current level is reached, the switch may be turned off. At the instant (e.g., within several milliseconds, or tens of milliseconds, or less) the switch turns off, the appropriate MOSFET body diode will be forced into conduction to provide a path for the decreasing actuator current. To maintain the current at any substantially static level, the converter can continually alternate between switch and diode conduction.

Figure 9:
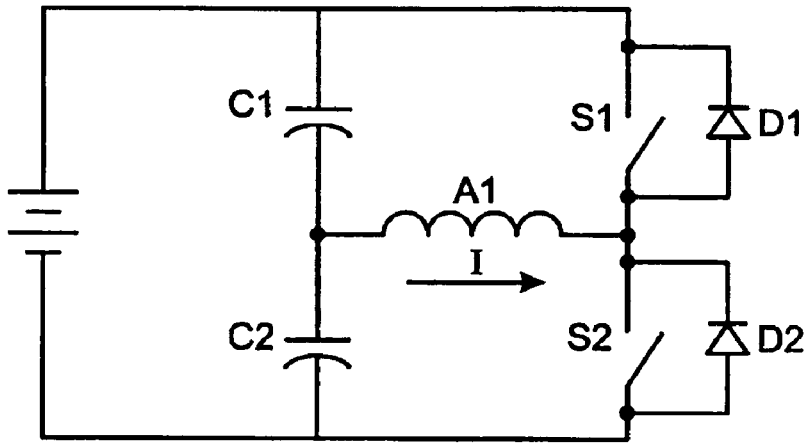
FIG. 9 shows an expanded single phase circuit diagram.

The diagram in FIG. 9 shows an expanded view of the circuit for a portion a bi-directional dual coil converter. This view consists of a single actuator coil (A1), the split capacitor power supply (C1, C2, and 510) and a pair of power MOSFETS (S1 and S2, using the MOSFET of FIG. 8). When S2 is closed, the current increases in the positive direction, and when S1 is closed, the current increases in the negative direction in the coil of A1. After the current has reached the desired level, the respective switch is turned off and the current is allowed to decay via conduction of one of the MOSFET body diodes.

Table 1 shows the particular element generally responsible for each of the converter's four conduction modes. It shows how for a given direction of current, the switch will conduct when the magnitude is increasing (positively or negatively) and the opposing diode will conduct when the current magnitude is decreasing (collapsing toward zero). As an improvement in overall efficiency, even though the diode will automatically conduct, often the power switch will be switched on across the already conducting diode, to further decrease the voltage drop, in one example embodiment. Note that in Table 1, positive and negative slopes refer to the voltage across the coil.

TABLE 1

Power Element Conduction Table

| Conduction mode | | Conducting element |
|---|---|---|
| Positive current | Positive slope | S2 |
| Positive current | Negative slope | D1 |
| Negative current | Negative slope | S1 |
| Negative current | Positive slope | D2 |

Figure 10:
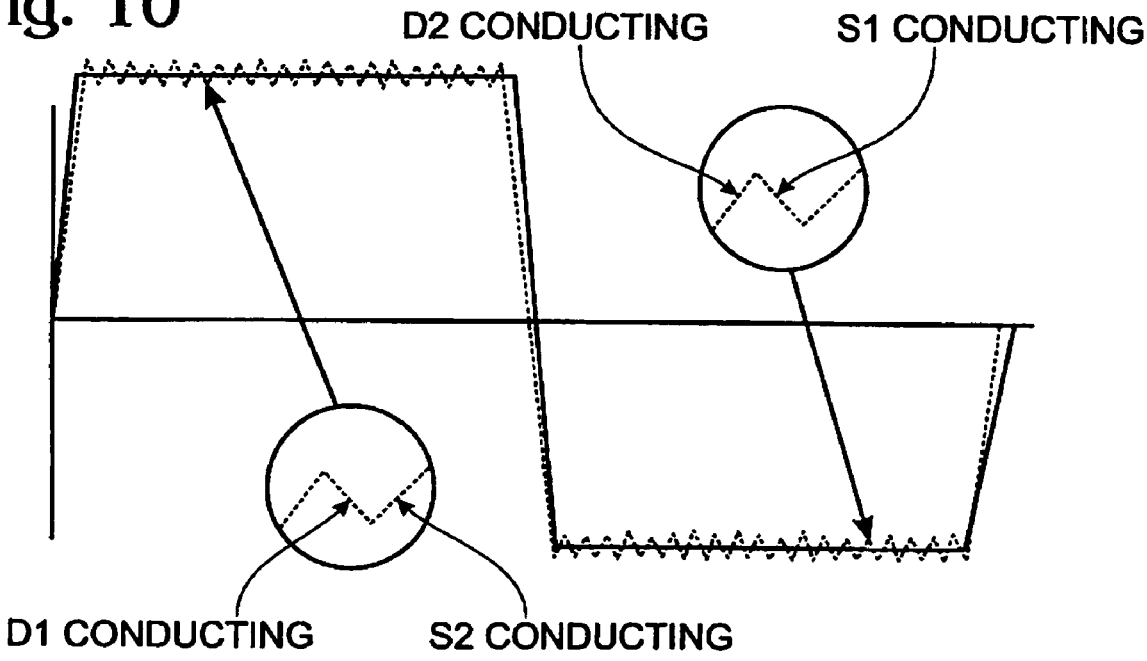
FIG. 10 shows current waveforms (command vs. actual) illustrating example circuit operation.

As a further example, an example switching waveform is shown in FIG. 10. This waveform illustrates the conduction contribution of each of the four circuit components in a current waveform. Both the current reference (command) and actual current are shown for comparison. Note that this is just an example for illustrative purposes.

Capacitor Balancing

Note that the split-capacitor voltage source arrangement may result in different charges being stored in the capacitors, due to the unequal current applied to different coils (e.g., opening versus closing, intake versus exhaust, or combinations thereof, for example). In other words, the balance of charge can be affected by the configuration of these coils in the dual coil half-bridge converter, and therefore the configuration can cause various types of results. Thus, in one example, system configuration is selected to maintain the balance of the charge on each capacitor. However, this system has to contend with the high number of coils in the engine, and the wide range of current that each is conducting.

One method of connecting the coils that assists in advantageously maintaining the required balance is to connect an equal number of similar loads in either the buck DC/DC converter configuration or the boost DC/DC converter configuration. When the total load through the buck converter connected coils matches that through the boost converter connected coils, a natural balance of the split voltage supply can occur. An example arrangement may be to have an equal number of intake valves opening via positive current flow (e.g., S1) switches and negative current flow, and also an equal number of exhaust valves opening via positive current flow and negative current flow. However, other arrangements could be used. In this way, it may be possible to maintain charge balance even when the engine operates with less that all of the valves (e.g., in a partial cylinder mode, or variable displacement engine (VDE) mode). Thus, in one example, under selected engine operating conditions (e.g., low load, or low torque requirement), the engine operates some cylinders (e.g., half) without fuel injection, thereby deactivating those cylinders (and potentially the valves for those cylinders), during a cycle of the cylinder or the engine. This allows for improved fuel economy by lowering pumping work, yet maintaining an exhaust air-fuel ratio about stoichiometry, for example.

In another example, a 4 valve, V-8 engine can be used. This configuration may provide even more opportunities for configuring the connection of the actuator coils. Here, one intake valve can be configured to be opened with a positive current flow, one intake can be configured to be opened with a negative current flow, one exhaust can be configured to be opened with a positive current flow, and one exhaust can be configured to be opened with a negative current flow. In this way, it may be possible to achieve substantial charge balance not only for the full engine, but also on a single cylinder basis.

Note that various other engine operating modes can be used. For example, under some operating conditions, all valves are actuated in each engine cycle in a four-valve per cylinder engine. However, under some operating conditions of a four-valve per cylinder engine (such as lower airflow conditions, for example) one intake valve, or one exhaust valve, or combinations or subcombinations thereof, may be deactivated. Further, in another example, two intake valves and two exhaust valves can be actuated on alternating engine cycles. Even in the further example case of a three-valve engine, the intake valves may be alternated (every cycle, or partially deactivated during selected modes), to improve engine operation at light throttle, and save energy.

However, the inventors herein have recognized that at least some of these various alternative modes of operation can affect the balance of charge. Thus, by proper selection of which valves to actuate and which to hold closed on each cylinder, it may be possible to obtain improved charge balance in the converter. Further, proper selection for each cycle can also aid in maintaining the balance of the split voltage supply. Likewise, during VDE (Variable Displacement Engine) operation, the charge balance can be maintained by choosing to disable the cylinders in natural charge sharing pairs. Also, by appropriately selecting the connection of the coils in the converter, improved charge balance may be achieved. Thus, in addition to selecting which valve to operate, coil connection in the converter can be used to improve balancing. I.e., obtaining charge balance through selection of which valve to operate limits the operating modes available, whereas connecting the coils in a preferred fashion increases the operating modes available.

The concept described above for configuring the actuator coils to the split voltage supply can also be applied to other engine configures (I4, V6, etc.) and to differing number of intake and exhaust valves. In addition, the two examples shown above are just one of many configurations for a V-8 engine (e.g., swapping the coils opened by the positive current flow and negative current flow are just one of many potential other arrangements).

Active Voltage Balance Control

While circuit and actuator configuration may be able to improve charge balancing, in some examples active voltage control may be used. In other words, since the actuator loads may not be exactly equal, an additional method of maintaining the charge balance (and providing the desired voltage on each of the capacitors), may be needed. Therefore, in one embodiment, a midpoint voltage regulator (MVR) can be used as discussed in more detail below.

Note that the desired voltage across each of the capacitors can be determined by the ratio of the individual stored charge and the capacitance value ($V=q/C$). This ratio may be chosen to be unity, i.e. equal voltage across each capacitor, or some other value depending on the requirements of the system.

Figure 11:
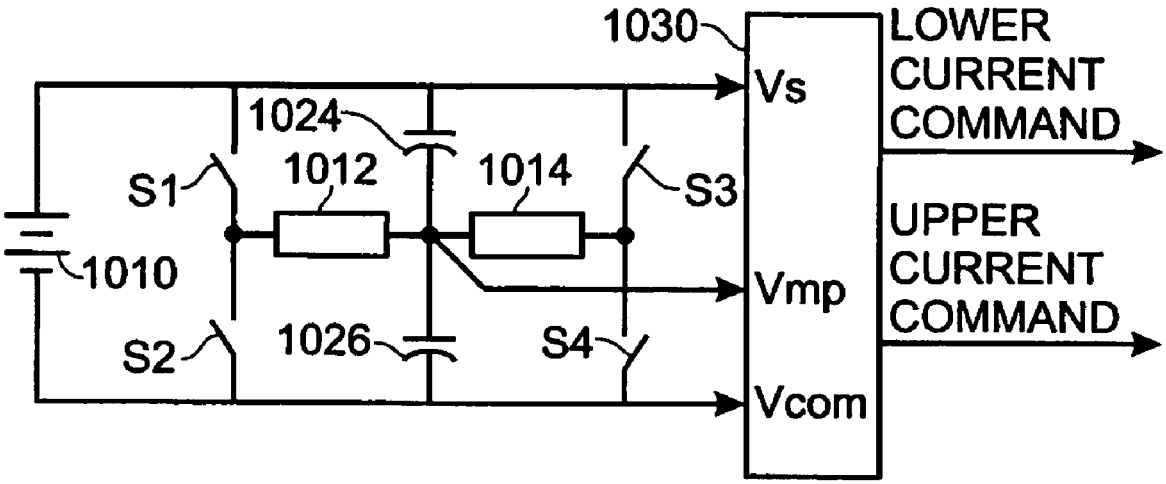
FIG. 11 shows a midpoint voltage regulator circuit (split supply)

Referring now to FIG. 11, an example midpoint voltage regulator (MVR) is shown. In this case, a power supply 1010 is shown coupled to bi-directional a dual coil converter, which in this example uses only two coils (1012 and 1014, although more could be used, if desired) actuated by switches S1-S2 and S3-S4, respectively. In this embodiment, the MVR (1030) maintains a desired ratio voltage across each of the capacitors (e.g., 1024 and 1026 in FIG. 11). This is accomplished by monitoring the supply and midpoint voltages, and then performing a regulation function that keeps the midpoint (MP) voltage at a desired level (which can vary with engine and or cylinder operating conditions).

In one example, the regulation can be accomplished by exploiting the inherent buck and boost converter actions, described above. Specifically, by commanding additional buck action when the MP voltage gets too low (and/or additional boost action when the MP voltage gets too high) a mechanism for providing the regulation function can be implemented.

One method that can be used to implement a midpoint voltage regulator is to add an additional buck/boost DC/DC converter in parallel with the converter, whose purpose is to provide a regulation function, although it can be used for other functionality, if desired. While this approach can achieve the desired result, it may add costs and unnecessarily waste energy in its operation. Therefore, in an effort to improve overall operation, an alternative embodiment uses another form of a midpoint voltage regulator. Specifically, this alternative midpoint voltage regulator uses the actuator coils (the dual coil converter) to implement the desired regulation. This is achieved, as described below, without compromising the primary current control function of the converter.

Note that in many applications, midpoint voltage regulation using the actuator coils would not be possible because each of the loads (actuators) on the converter would be required to follow a current command that cannot be varied for any ancillary purposes. However, in the application for engine cylinder valve actuation, actuator current regulation is required to follow a specific command under some conditions (such as specific transient periods of operation). But, under other conditions, actuator current can vary within a larger range from the desired value. Recognition of this allows synergistically exploitation of the circuit structure to enable midpoint voltage regulation without unnecessarily wasting energy. In other words, this provides the opportunity to interleave midpoint voltage regulation within the normal actuator current control function.

Figure 12:
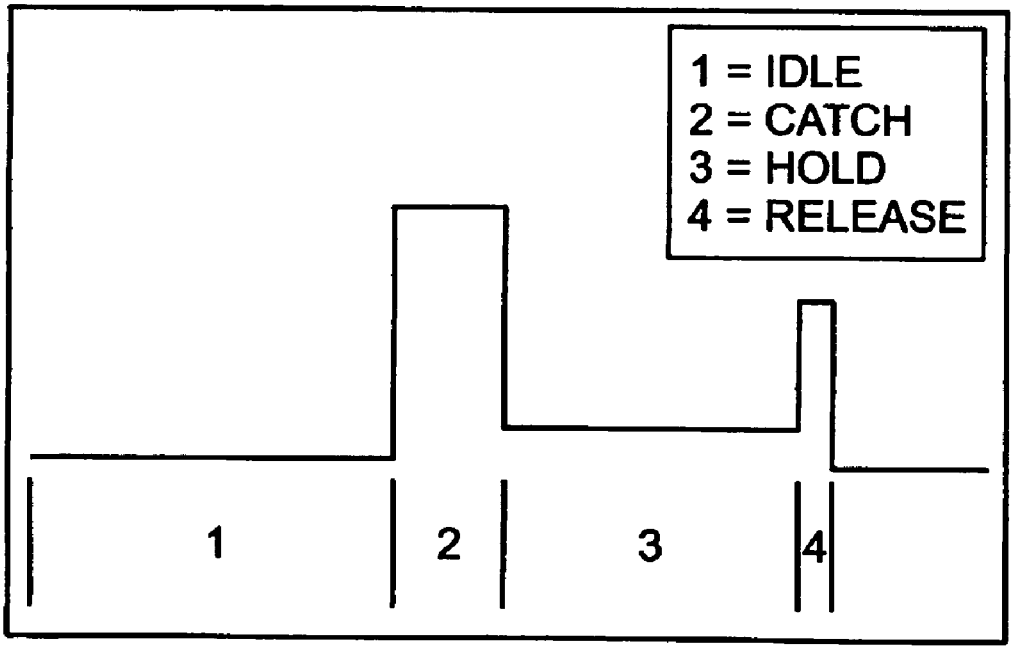
FIG. 12 shows an example EVA actuator current profile.

The waveform shown in FIG. 12 shows an example EVA actuator current profile. It is broken into four distinct periods (valve modes) of operation: idle (1), catch (2), hold (3), and release (4).

Higher precision current control is used during modes 2 and 4, as these are the periods when the valve is transitioning. However, during the idle mode, current can be adjusted to a greater degree because during an idle period a particular coil is not needed for control of the actuator armature. Further, during this duration, the air gap between the coil and actuator is sufficiently large that the force produced by any current in that coil has a small effect (i.e., the valve position is substantially unaffected by the variation in current, such as, for example, less than 5% or less than 1% of total travel movement). Likewise, during the hold mode, the actuator is firmly held in either the fully open or fully closed position and although the current must not be reduced too much, it can be increased without significant effect on valve position.

These two periods constitute the majority of the total actuator cycle and provide a significant opportunity for allowing voltage regulation. In other words, the ability to adjust current during modes 1 and 3 is more than adequate for achieving the desired midpoint voltage regulation, in some examples. The large number of individual actuators and coils in a typical EVA system also provides advantages for the midpoint voltage regulator being disclosed since the multiple coils that are in either the hold or idle phase are used in parallel with each other for the midpoint voltage regulation, resulting in a reduced load per coil. Furthermore, it can result in an effective bandwidth for the voltage regulation that is higher than that of a single coil alone, or that of using a specialized voltage regulator that is added to the circuit.

Figure 12A:
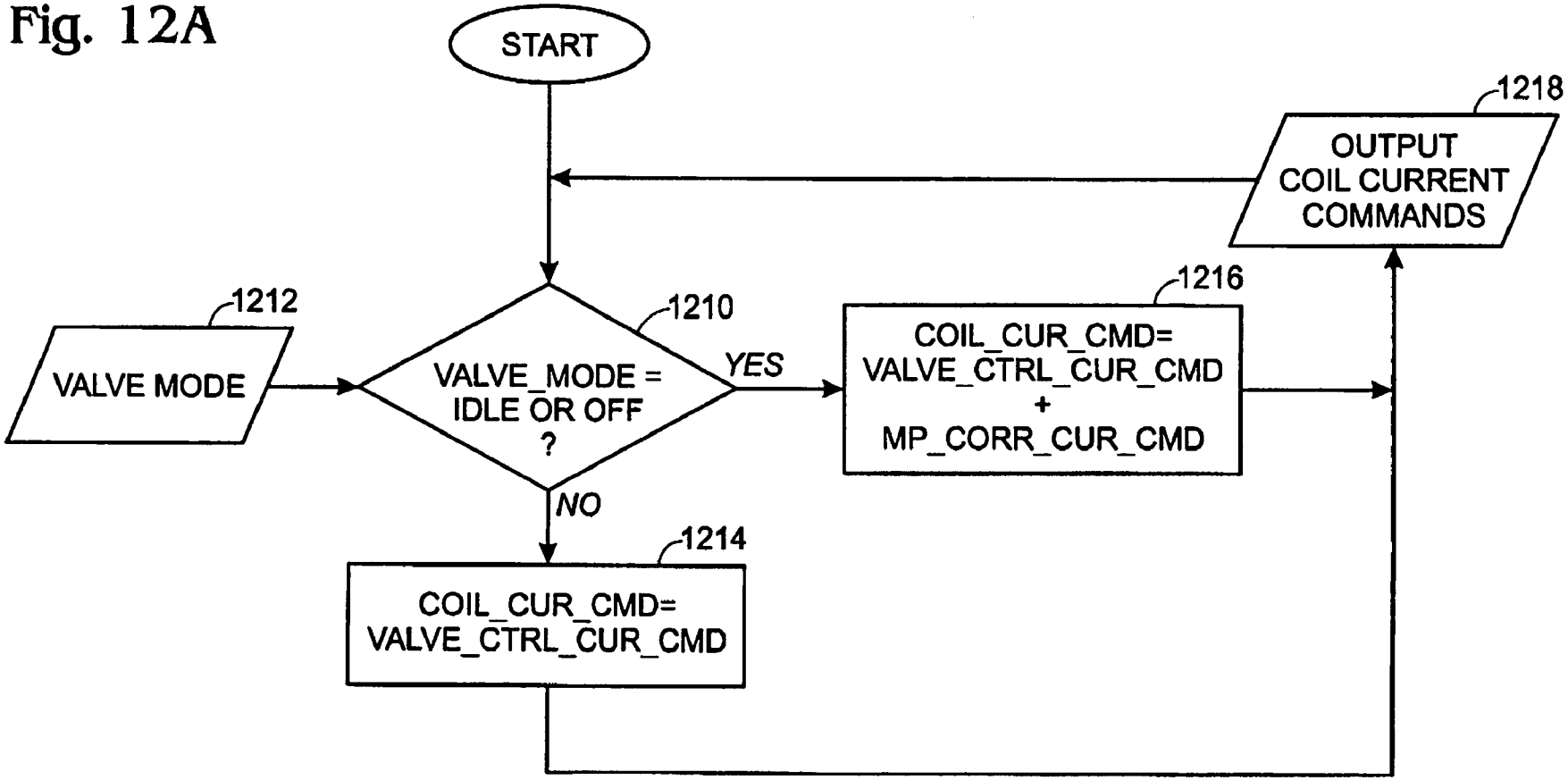
FIG. 12A shows a coil current control command generator flow chart.

The flowchart shown in FIG. 12A depicts the process of adding the MVR correction commands to a single actuator coil current control command. In this flowchart the valve controller current command (VALVE_CTRL_CUR_CMD) is the target current command generated by the valve position controller. The midpoint correction current command (MP_CORR_CUR_CMD) is the additional command used for midpoint regulation. Since the midpoint voltage regulator generates different commands depending on whether midpoint voltage correction is desired using either positive current flow open or negative current flow open actuator coils, the above flowchart would be duplicated for each of the two types of actuator coils (positive current flow and negative current flow), with MP_CORR_CUR_CMD shown in the flowchart corresponding to the appropriate correction command (U_CMD or L_CMD) from the midpoint voltage regulator. In addition to the method shown in FIG. 12, the correction commands may be further restricted to be applied to only coils that are in the idle mode or only coils that are in the off mode or both, if so desired.

The control routines included herein can be used with various engine configurations, such as those described above. As will be appreciated by one of ordinary skill in the art, the specific routine described below in the flowchart(s) may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the features and advantages of the example embodiments of the invention described herein, but are provided for ease of illustration and description. Although not explicitly illustrated, one of ordinary skill in the art will recognize that one or more of the illustrated steps or functions may be repeatedly performed depending on the particular strategy being used. Further, the flowchart(s) graphically represents code to be programmed into the computer readable storage medium in controller 12 or 210.

Referring now specifically to FIG. 12, in step 1210, a determination is made as to whether the valve mode is in the idle condition, or the off condition, based on an input 1212 from the valve position controller. As noted above, additional valve conditions could be added, such as whether the valve is in the hold mode, for example. When the answer to step 1212 is NO, the routine continues to step 1214 to set the current coil command (COIL_CUR_CMD) to the valve control current command (VALVE_CTRL_CUR_CMD), so the no adjustment to the current is made to regulate the midpoint voltage. Alternatively, when the answer two step 1210 is YES, the routine continues to step 1216 to add a feedback correction voltage (MP_CORR_CUR_CMD) to the valve control current command (VALVE_CTRL_CUR_CMD) to form the current coil command (COIL_CUR_CMD) in step 1216. The feedback correction is based on, in one example, a difference between a desired midpoint voltage and measured midpoint voltage, along with a proportional gain. However, in an alternative embodiment, integral control action can be added, if desired. From either step 1214 and 1216, the routine continues to step 1218 to output the coil current commands.

Figures 13, 14:
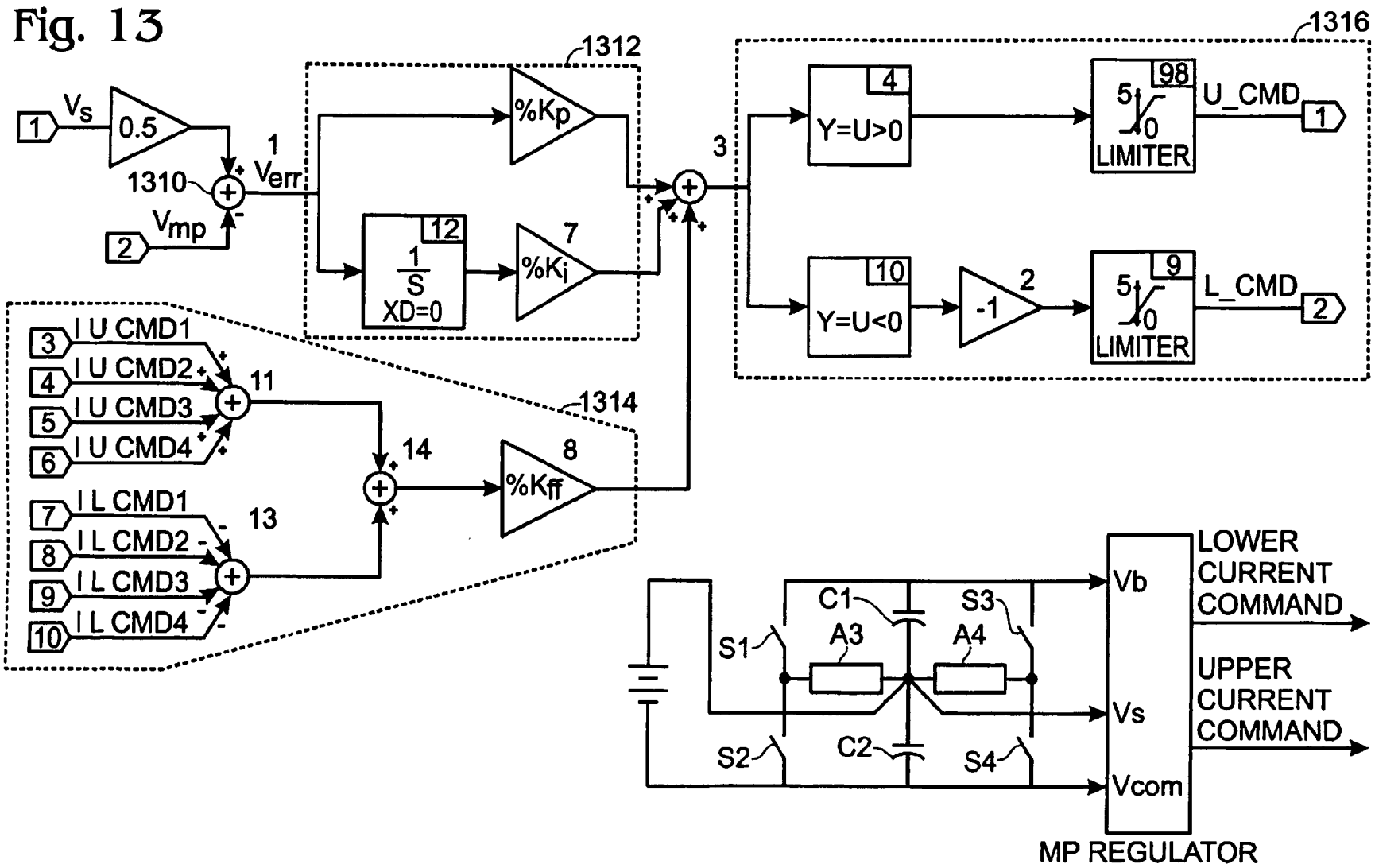
FIG. 13 shows a feedback (P-I) and feedforward (FF) correction current controller (shown for 8 coils)
FIG. 14 shows a midpoint voltage regulator circuit (boosted supply).

An example of the control algorithm that can be used to generate the two midpoint voltage correction current commands (U_CMD & L_CMD) is shown in FIG. 13, which shows proportional and integral control action, along with feedforward control action using a prediction of the required action needed to maintain midpoint voltage regulation. Furthermore, limits are shown to prevent integrator windup, as well as to reduce over adjustment to coil currents during engine operation.

The operation of this controller is as follows. The input signals ½ $V_S$ (a one half gain is used since the midpoint voltage is being regulated to be equal to one half of the source voltage) and $V_{MP}$ (measured or estimated midpoint voltage) are summed to generate the midpoint voltage error ($V_{ERR}$) at 1310. This error quantity is then acted on by a proportional-Integral (PI) controller at 1312, producing a feedback correction command. This feedback correction command is summed with the feed-forward correction command generated with a feed-forward controller 1314, using feedforward gain ($K_{FF}$) and a sum of all of the current commands for the actuators (note that this example shows four actuators, although more could be used, if desired). The three gain blocks ($K_P$, $K_I$, and $K_{FF}$) are all user programmable gains to tune and control the algorithm operation, which can vary as operating conditions change, in one example. The sum of the feedback and feed-forward correction commands is then compared to determine its sign at 1316. If this command is positive, a magnitude limited current command (U_CMD) will be generated, while the (L_CMD) command remains at zero. Should the sign of the error be negative, then a magnitude limited current command (L_CMD) will be generated, while the (U_CMD) remains at zero.

The feed-forward controller 1314 shown is based on the unmodified valve control current commands. Each of the current commands for the positive current flow open coils are summed with the negative summation of the current commands for the negative current flow open coils. The resulting signal is an estimate of the charge imbalance that will be generated on the capacitor banks as a result of these current commands, which can be a good estimate of the instantaneous correction needed by the midpoint voltage regulator. Therefore, in one example, a typical feed forward controller gain ($K_{FF}$) would be equal to 1/(the total number of coils used to achieve the midpoint regulation). By choosing the gain in this way, the feedforward controller estimates the incremental current that needs to be commanded to each of the coils used to maintain the midpoint regulation.

After proper tuning of the three gain terms this controller can accurately maintain a balanced pair of capacitor voltages.

Another alternative embodiment of the dual coil converter is shown in FIG. 14, termed the boosted supply version. In this version the battery is connected directly across the lower supply, (capacitor C2), fixing its voltage at the battery voltage level. The upper voltage is generated by the coil return current through the upper capacitor, when the upper power switches are conducting. A boost action induces a voltage across the upper capacitor and forms the upper (boosted) supply. The control techniques for this derivative are similar to that of the previously mentioned "split supply" version of the dual coil half bridge converter in FIG. 10. One potential difference is that the voltage levels can be higher and that the upper voltage level is no longer bounded by the battery voltage.

However, based on the circuit design, there is a potential for the boosted voltage to reach a higher than desired amount.

One approach would be to form to equal voltages across each leg of the dual power supply. However, this topology is not limited to equal voltages. Rather, while the lower supply voltage is equal to the battery voltage, the upper voltage may be any level, including: twice the battery voltage or a certain fixed amount above the battery voltage. In this embodiment, the midpoint controller becomes essentially a boost voltage controller. Either form of this converter topology can be implemented with only minor circuit reconfigurations and appropriate changes to the component voltage or current ratings.

It will be appreciated that the configurations and routines disclosed herein are exemplary in nature, and that these specific embodiments are not to be considered in a limiting sense, because numerous variations are possible. For example, the above converter technology can be applied to V-6, I-4, I-6, V-12, opposed 4, and other engine types. Also, approach described above is not specifically limited to a dual coil valve actuator. Rather, it could be applied to other forms of actuators, including ones that have only a single coil per valve actuator The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

We claim:

1. A system comprising:

a power supply with a positive and negative terminal;

a first coil coupled to a cylinder valve actuator of an engine, said first coil having a first end and a second end;

a first switch coupled between said first end of said first coil and said positive terminal of said power supply;

a first capacitor coupled between said positive terminal of said power supply and said second end of said first coil;

a second switch coupled between said first end of said first coil and said negative terminal;

a second coil, said second coil having a first end and a second end, said first end of said second coil coupled to said second end of said first coil;

a second capacitor coupled between said first end of said second coil and said negative terminal;

a third switch coupled between said second end of said second coil and said negative terminal; and a fourth switch coupled between said second end of said second coil and said positive terminal.

2. The system of claim 1 where said negative terminal of said power supply is coupled to a ground.

3. The system of claim 1 where said switches control actuation of at least one cylinder valve of an internal combustion engine.

4. The system of claim 1 wherein said second coil is coupled to said cylinder valve actuator.

5. The system of claim 1 wherein said second coil is coupled to another cylinder valve actuator of said engine.

6. The system of claim 1 further comprising third and fourth actuators, wherein said system is configured to balance voltage across said first and second capacitors.

7. The system of claim 1 where said second end of said first coil is coupled to ground.

* * * * *